United States Patent [19]

Ueda et al.

[11] Patent Number: 4,805,846

[45] Date of Patent: Feb. 21, 1989

[54] AUTOMATIC WINDER

[75] Inventors: Yutaka Ueda, Nara; Shuzo Kawamura, Joyo, both of Japan

[73] Assignee: Murata Kikai Kabushiki Kaisha, Kyoto, Japan

[21] Appl. No.: 41,610

[22] Filed: Apr. 23, 1987

[30] Foreign Application Priority Data

Apr. 29, 1986 [JP] Japan ..... 61-98763
Jun. 4, 1986 [JP] Japan ..... 61-129938

[51] Int. Cl.[4] ..... B65H 54/02; B65H 59/00

[52] U.S. Cl. ..... 242/36; 242/18 R; 242/45

[58] Field of Search ..... 242/36, 39, 45, 18 R, 242/18 A, 18 DD, 49, 28, 35.5 R, 35.6 R

[56] References Cited

U.S. PATENT DOCUMENTS

| | | | |
|---|---|---|---|
| 3,774,860 | 11/1973 | Loepfe | 242/36 |
| 4,245,794 | 1/1981 | Hasegawa et al. | 242/45 |
| 4,330,094 | 5/1982 | Mayer | 242/36 |
| 4,394,986 | 7/1983 | Hasegawa et al. | 242/45 X |
| 4,458,849 | 7/1984 | Miyake et al. | 242/36 |
| 4,487,374 | 12/1984 | Sugioka et al. | 242/18 R X |
| 4,494,702 | 1/1985 | Miyake et al. | 242/36 X |
| 4,512,526 | 4/1985 | Tone et al. | 242/36 |
| 4,685,629 | 8/1987 | Sugioka | 242/36 X |

*Primary Examiner*—Stanley N. Gilreath
*Attorney, Agent, or Firm*—Spensley Horn Jubas & Lubitz

[57] ABSTRACT

In an automatic winder, an independent winding controlling means for adjusting a speed of winding of a yarn is provided for each of winding units of the automatic winder so that a break of a yarn due to a rapid increase of the yarn tension can be prevented.

19 Claims, 8 Drawing Sheets

AUTOMATIC WINDER

FIELD OF THE INVENTION AND RELATED ART STATEMENT

This invention relates to an automatic winder.

A spinning bobbin produced on a spinning frame, particularly on a ring spinning frame, is subsequently supplied to an automatic winder for a next step on which a yarn on the spinning bobbin is rewound onto a package of a predetermined shape by a predetermined amount while a defect included in the yarn is removed thereform.

In particular, in an automatic winder in which one or more winding units are arranged in a juxtaposed relationship, a yarn is drawn out from a spinning bobbin supplied by various supply means to a predetermined position of each winding unit and passes a tension device, a slub catcher or some other devices whereafter it is wound onto a package rotated by a traverse drum. Thus, in order to obtain a single package, several spinning bobbins are normally supplied for rewinding of yarns thereon.

In a winder of the type described above, a yarn drawn out from a spinning bobbin on the yarn supply side is introduced upwardly along a direction of an axis of the bobbin. Accordingly, a portion of the yarn which is spaced away from a layer of the yarn on the bobbin may move while ballooning.

When yarn remains in a layer of a sufficient thickness on the spinning bobbin, the yarn winding occurs without problems. However, as winding proceeds and the yarn layer on the spinning bobbin reduces in thickness, the reduced yarn layer will remain at a lower end portion of a take-up tube B as shown in FIG. 7. Accordingly, the yarn Y being released from the bobbin will move upwardly while wrapping around a surface of the take-up tube B at a reduced releasing angle from the yarn layer. Consequently, a tensile force is caused in the yarn by an excessive resistance due to a friction between contacting strings of the yarn or due to contact of the yarn with the take-up tube, which may cause a break of the yarn. Such a yarn break will occur more readily if the feeding speed of the yarn increases.

Or otherwise, when the yarn layer is reduced and the yarn released from the bobbin travels while contacting with an underlying layer of the yarn, a yarn break may sometimes be caused by so-called sloughing wherein coils of the yarn around the bobbin are drawn out upwardly at a rate of one coil at a time.

Accordingly, each time a yarn break occurs, winding is stopped to allow subsequent joining of the yarn. Thus, where a large number of spinning bobbins are supplied in order to produce a fully wound up package because the amount of a yarn on each of such spinning bobbins is generally one hundred to one hundred fifty grams, at most, if such a yarn break as described above occurs for each bobbin, this will lower the working efficiency of the winder.

OBJECT AND SUMMARY OF THE INVENTION

It is an object of the present invention to improve the working efficiency of an automatic winder and assure production of a package of a high quality on the winder.

According to the present invention, an independent winding controlling means for adjusting a speed of winding of a yarn, that is, a yarn feeding speed, is provided for each of winding units of an automatic winder.

By controlling the winding speed such that the feeding speed of the yarn may be lowered around the end of the winding operation of a spinning bobbin to control increase of the yarn tension which occurs when the yarn is released from the spinning bobbin around the end of the winding operation, a break of the yarn due to a rapid increase of the yarn tension can be prevented.

DETAILED DESCRIPTION OF PREFERRED EMBODIMENTS

Now, an embodiment of the present invention will be described with reference to the drawings.

Figure 1:
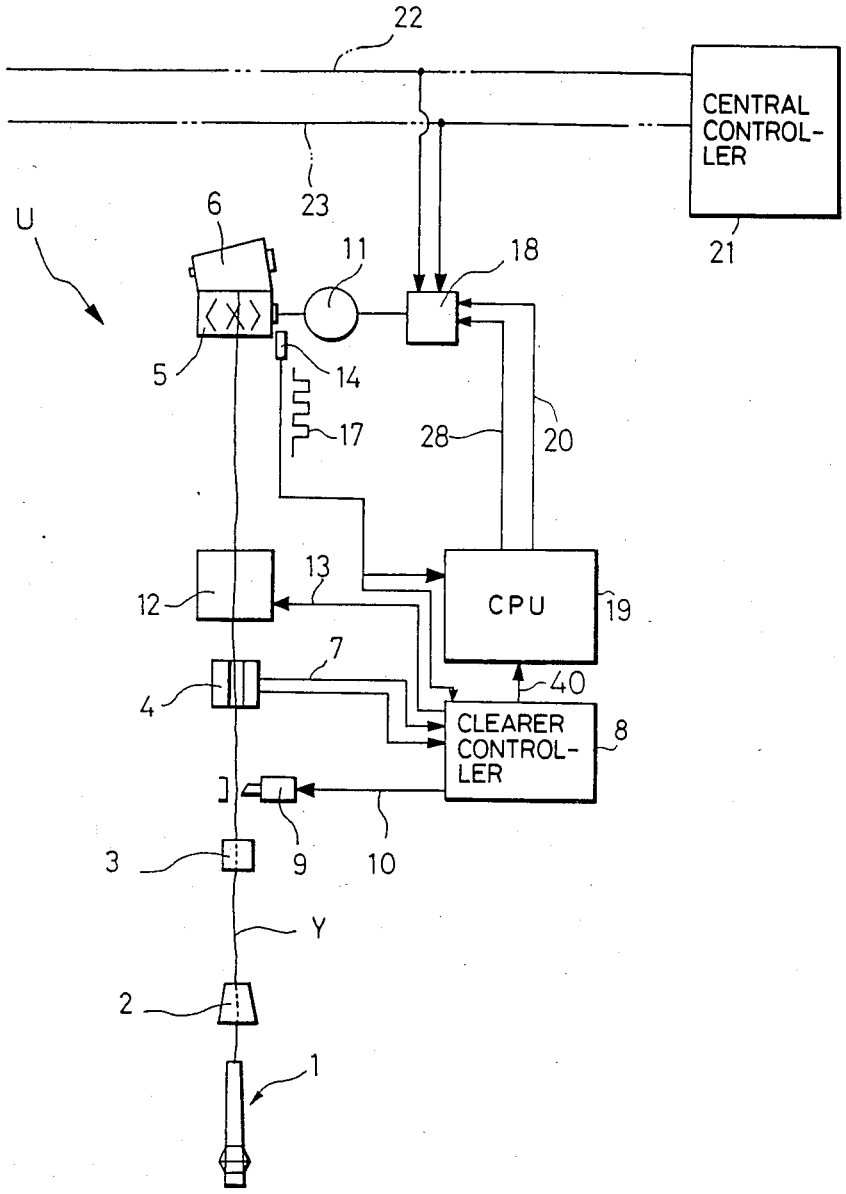
FIG. 1 is a diagrammatic representation showing general construction of an embodiment of a system of the present invention.

FIG. 1 illustrates an example of a winding unit which is included in an automatic winder. A yarn Y released and drawn out from a spinning bobbin 1 is passed through a balloon breaker 2 and a tension device 3 and then checked by a yarn defect detecting head 4 such as a slub catcher in order to check a defect of the yarn Y, whereafter the yarn Y is wound onto a package 6 which is rotated by a traverse drum 5.

During winding of the yarn Y, the varying thickness of the yarn passing through the slub catcher 4 is normally delivered as an electric signal 7 to a clearer controller 8 and is compared therein with a reference value. In case the yarn thickness is out of an allowable range, the clearer controller 8 judges that a yarn defect has passed the slub catcher 4 and immediately delivers an instruction signal 10 to a cutter driving device 9 so that a cutter may operate to cut the yarn Y. After the yarn Y is thus cut, the yarn feeding signal is not more developed from the slub catcher 4, which represents that the cutting of the yarn Y is sensed. Consequently, the controller 8 delivers a stopping instruction to a traverse drum driving motor 11 to stop rotation of the traverse drum 5.

Subsequently, an instruction signal 13 for starting a yarn splicing operation of a yarn joining device 12 is delivered from the controller 8 so that a yarn joining operation is thus carried out by a known yarn knotting or splicing means.

It is to be noted that reference numeral 14 in FIG. 1 denotes a pulse generator device for detecting rotation of the traverse drum 5, and the pulse generating device 14 includes, for example, a magnet 15 (FIG. 8) located on an end face of the traverse drum 5 and an adjacent sensor 16 and is connected to deliver a pulse signal 17 generated therefrom to a fixed length measuring mechanism for calculating a length of the yarn wound onto the package 6 from a rotational frequency of the drum 5 so that the pulse signal 17 may be stored in and processed by the fixed length measuring mechanism. The pulse signal 17 is used also for calculation of a speed of a yarn during winding.

Further, according to the present invention, the drum driving motor 11 is provided for each of winding units of the winder as seen in FIG. 1, and the speed of rotation of each of the drum driving motors 11 is controlled by an inverter 18 which is provided for each of the winding units. In particular, each of the winding units has provided therefor a controlling device 19 for controlling the associated motor to rotate at a speed most suitable for winding on the associated winding unit, and the speed of rotation of the drum motor 11 is set by way of the inverter 18 in accordance with a control signal 20 which is delivered from the controlling device 19.

It is to be noted that all or every one of the winding units of the winder is controlled by way of the associated inverter 18 over control lines 22, 23 extending from a central control unit 21. Contents of control commonly over all of the winding units include, for example, setting of a basic yarn feeding speed depending upon a type of yarns to be processed, and an on/off signal for ribbon breakers.

Figure 6:
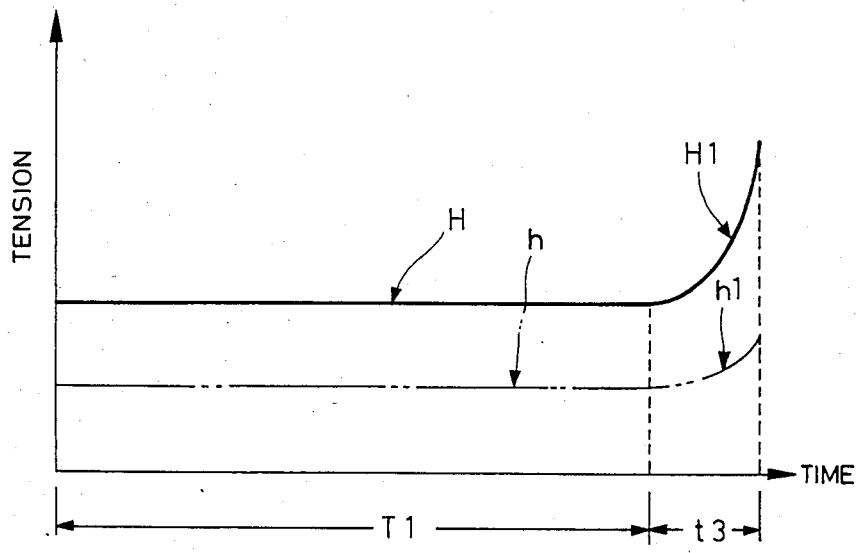
FIG. 6 is a diagram illustrating a variation of the yarn releasing tension.
Figure 7:
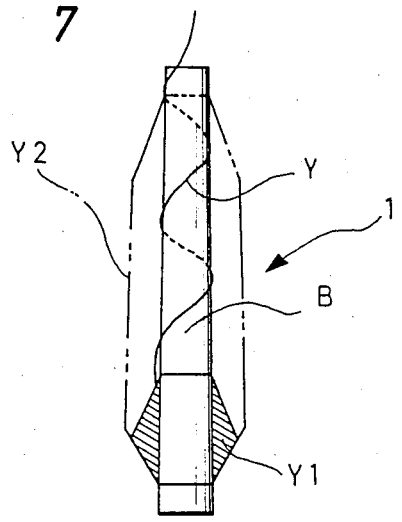
FIG. 7 is a diagrammatic view illustrating a position of a remaining yarn on a spinning bobbin.

Now, controlling of a yarn feeding speed by the inverter 18 for each winding unit will be described. In particularly, a feeding speed of a yarn is controlled in accordance with a change in tension as illustrated in FIG. 6 as described hereinabove. As a yarn is released and drawn out from a spinning bobbin 1 shown in FIG. 7 and is wound onto a package, yarn releasing tension is maintained at a substantially constant level H for a particular interval of time T1 after starting of winding of the yarn from the spinning bobbin 1 in a fully wound up condition. Meanwhile, the thickness of a layer of the yarn is gradually decreased, and after, for example, a remaining yarn amount Y1 shown in FIG. 7 is reached, the yarn releasing tension increases H1 rapidly and progressively as at H1 for an interval of time t3. It is to be noted that where the winding speed is low as at h, the increase in tension is also low as at h1.

In such an instance, the yarn feeding speed is lowered in order to prevent a possible yarn break due to an increase in tension. In the arrangement shown in FIG. 1, when the controlling device 19 detects that a particular preset time T1 calculated from a full amount of a yarn on a bobbin and a yarn winding speed then has elapsed after the bobbin was supplied to the winding unit, it delivers a decelerating instruction to the inverter 18 in order to lower the yarn winding speed on the winding unit.

In particular, it is assumed here that a time required to wind up a yarn from a fully wound up bobbin such as, for example, shown in phantom Y2 in FIG. 7 without causing a yarn break after the bobbin has been supplied to the winding unit is represented T (FIG. 2), a rising time upon starting of such winding is represented t1, a winding time at a normal set speed is represented t2 and a time within which tension varies as seen from FIG. 6 is represented t3. Thus, the controlling device 19 calculates a time T1 from the point of time at which the bobbin is put in place of another bobbin, and after lapse of the time T1, delivers a deceleration instructing signal 20.

It is to be noted that a method wherein a program for operation within the controller 19 is used or another method wherein the number of pulses 17 generated upon rotation of the drum 5 as shown in FIG. 1 is converted into a time or some other suitable method may be selectively used for the method of calculation of the time T1 described above. It is also noted that FIG. 3 illustrates setting of a time at which a decelerating instruction is to be delivered to the inverter 18 when a yarn break occurs during winding. In particular, if it is assumed that a yarn break occurs after lapse of a time T2 after starting of winding and then a time tS is spent for splicing of the yarn whereafter winding is restarted, the time corresponding to the time T1 shown in FIG. 2, that is, the time during which a yarn is actually fed before the decelerating instruction is delivered, is equal to $T2+T3$, and accordingly $T1 \approx T2+T3$. Thus, in the case of the arrangement of FIG. 3, by delivering a deceleration signal to the inverter after lapse of the time $T3 \approx T1-T2$ after re-starting of winding, the yarn speed can be lowered when the yarn tension becomes increased.

Figure 2:
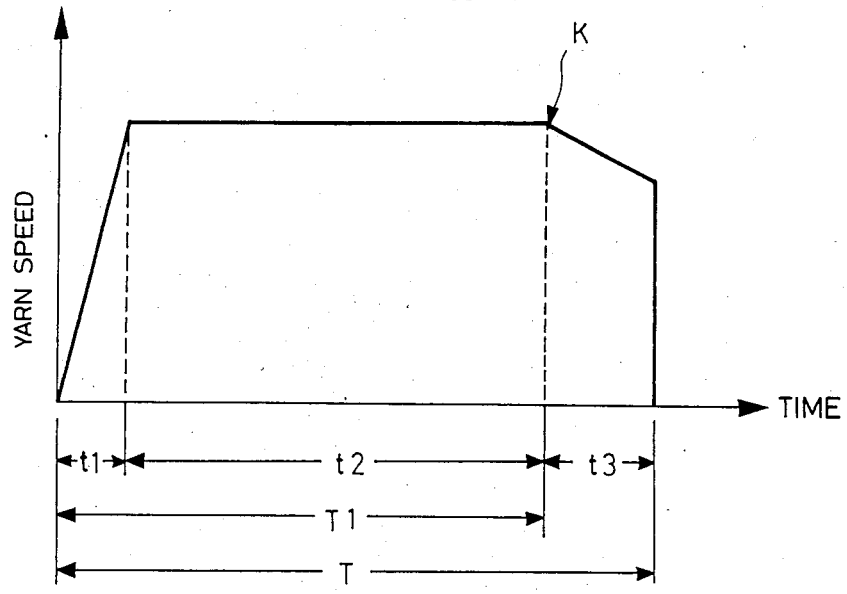
FIGS. 2 and 3 are speed diagrams illustrating yarn speed controlling conditions.
Figure 3:
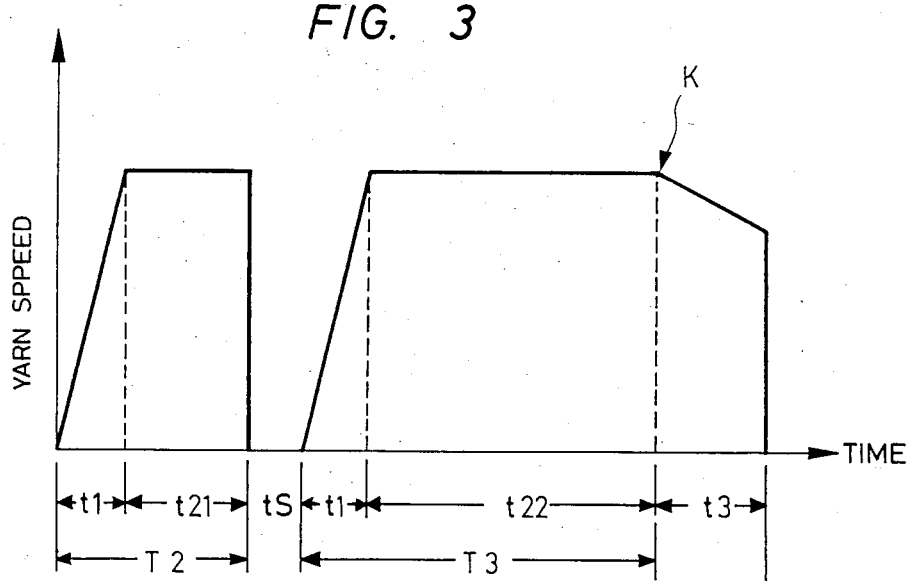
Figure 4:
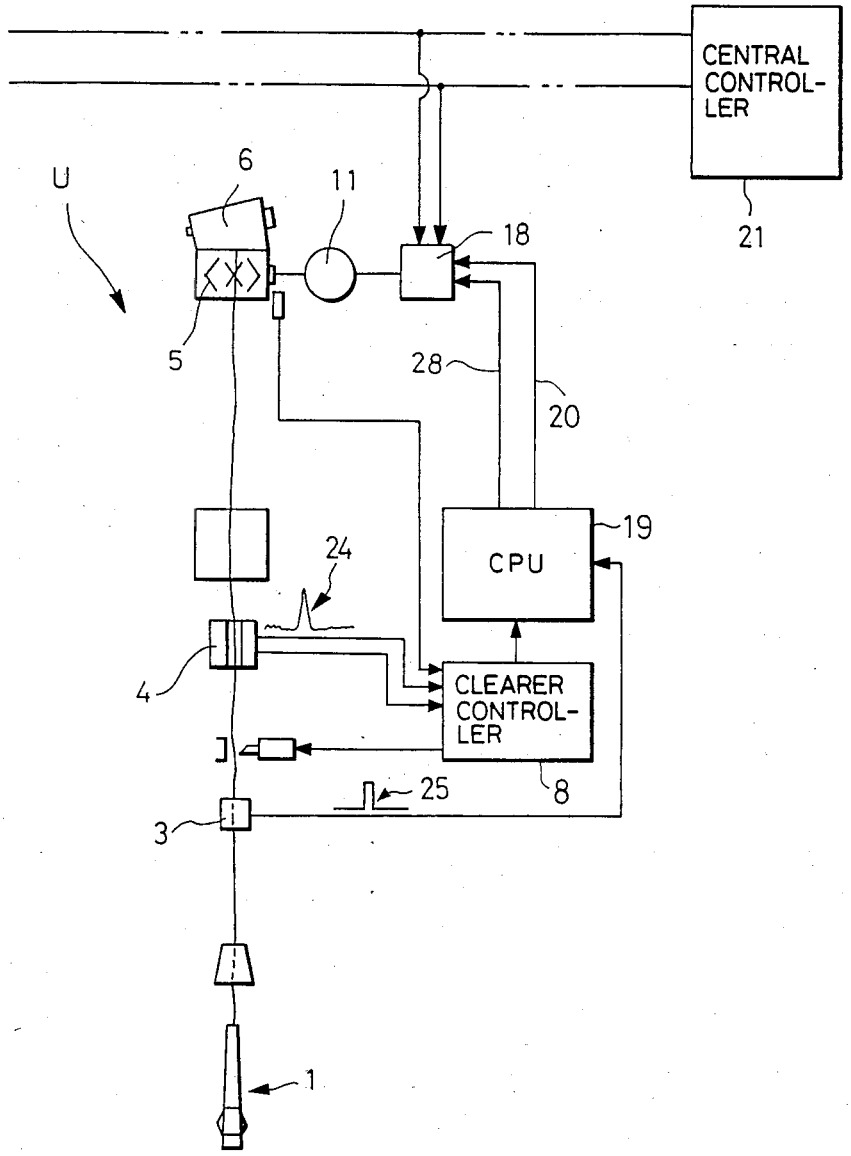
FIG. 4 is a diagrammatic representation showing general construction of another example of means for obtaining a timing at which a decelerating instruction is to be issued.

Further, another means for obtaining a timing K as shown in FIGS. 2 and 3 at which a deceleration instruction is to be developed is shown in FIG. 4. In particular, in this arrangement, when the slub catcher 4 delivers an emergency signal in response to sloughing which may occur at a bobbin 1 on which a yarn layer of a reduced thickness remains, a deceleration instruction is delivered from the controlling device 19 to the inverter 18 in order to control the feeding speed of the yarn in a similar manner to that in the deceleration region t3 of FIG. 2. Or otherwise, a gate sensor may be used for the tension device 3 so that when a lump of a yarn when sloughing occurs acts to push open the gate sensor, a detecting means may detect such a behavior of the tensor and deliver a sloughing signal 25 to the controlling device 19 to cause the controlling device 19 to deliver a decelerating instruction to the inverter 18.

Figure 5:
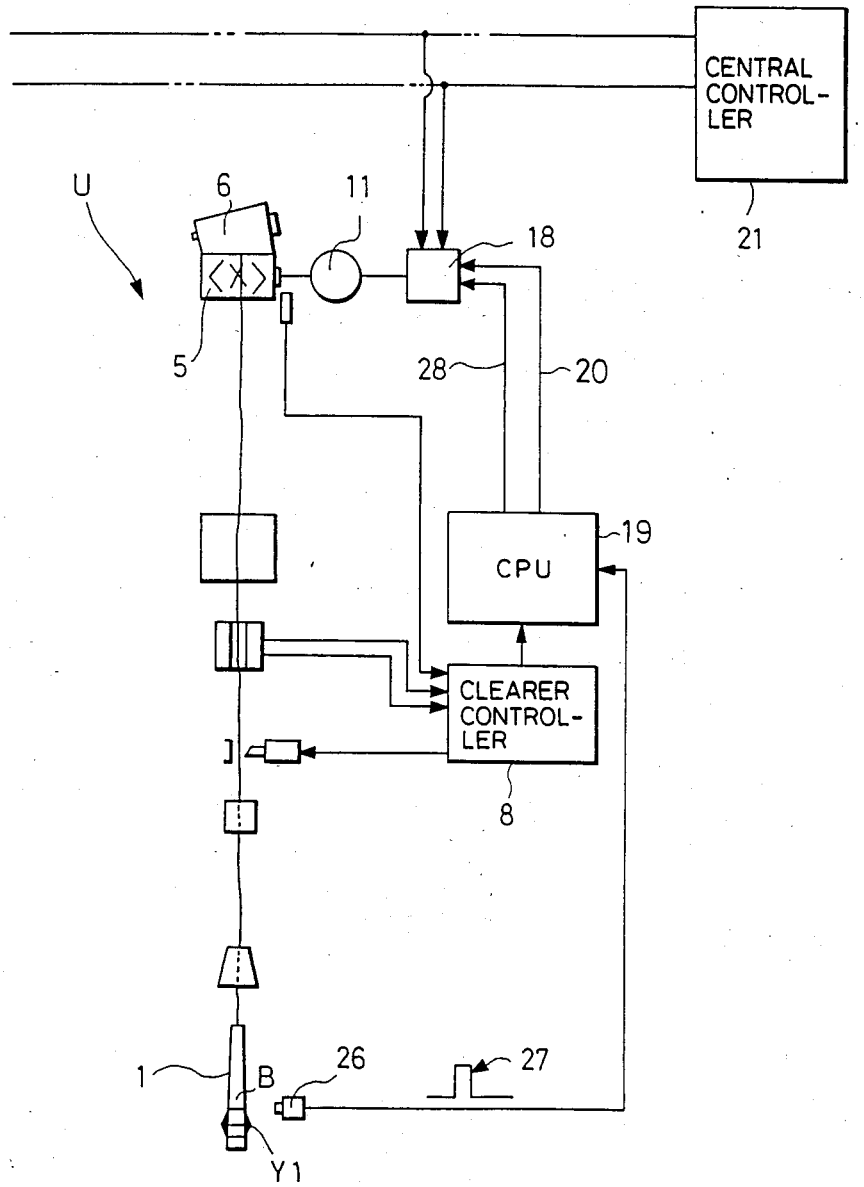
FIG. 5 is a diagrammatic representation showing general construction of a further example of the means.

Further, FIG. 5 illustrates a further means for detecting such a point K as described above at which the yarn releasing tension begins to increase. In the present embodiment, reduction of a yarn layer in thickness can be directly detected. Thus, for example, a photoelectric tube sensor 26 may be used in order that a region wherein sloughing will occur as a result of reduction in thickness of a yarn layer and a point K at which the yarn releasing tension starts to increase rapidly may be detected utilizing a difference between amounts of light reflected from the yarn layer Y1 and the winding tube B. When the photoelectric tube sensor 26 detects reduction in thickness of the yarn layer, a signal 27 representing this is delivered similarly to the controlling device 19 to cause the controlling device 19 to deliver a deceleration instruction signal 20 to the inverter 18.

It is to be noted that while in the embodiments of FIGS. 1, 4 and 5 instruction signals 28 for starting and stopping the drum motor 11 are delivered from the controlling device 19 to the inverter 18, in this instance, a stopping signal derived from a fully wound up signal from the fixed length measuring mechanism or produced upon occurrence of a yarn break is delivered to the inverter in order to stop the drum motor 11, and then a starting signal is delivered from the controlling device 19 to the inverter 18 in order to start the drum motor 11 after a new bobbin has been supplied or after completion of a yarn splicing operation.

In such a manner as described above, by controlling an inverter provided for each of winding units of an automatic winder such that the feeding speed of a yarn may be lowered in accordance with a result of automatic judgement by a program at ending of winding of a spinning bobbin or in response to detection of an increase of yarn tension or of an amount of a yarn left on the bobbin, rotation of a drum motor is lowered to prevent a possible increase of the yarn releasing tension.

It is to be noted that the rate of reduction in the yarn feeding speed varies depending upon a type of a yarn but can be set to an arbitrary value so far as at least a yarn break is prevented and no end face skip nor harness skip is caused on the package side by rapid reduction in the yarn feeding speed. End face skip, also called end missing, refers to the state when a yarn end drops off the yarn layer on a yarn package and wraps around the take-up tube of the yarn package. Harness skip, also called stitch, refers to the condition when a yarn portion, which is successfully wound across a yarn layer on a yarn package, is temporarily dropped from the edge portion of the yarn layer. However, although the average yarn feeding speed during the time t3 in FIGS. 2, 3 is lower than that during the ordinary running time t2, the time t3 is at most 10 percent of the entire time T, and accordingly if a time required for yarn joining when a yarn break occurs is taken into consideration, there is little deterioration forecast in the working efficiency.

It is to be noted that even though such reduction in the yarn feeding speed as described above may prevent a possible yarn break which may occur as a result of increase in the yarn feeding tension, if the setting of the sensitivity in the slub catcher 4 relative to the thickness of a yarn is left constant, the length of a defect of a yarn such as a slub or a nep becomes relatively long relative to a somewhat long reference length as the yarn feeding speed decreases, and consequently a portion of the yarn which is not detected as a defect in a normal operating condition may be regarded as a defect and thus cut away from the yarn.

Figure 9:
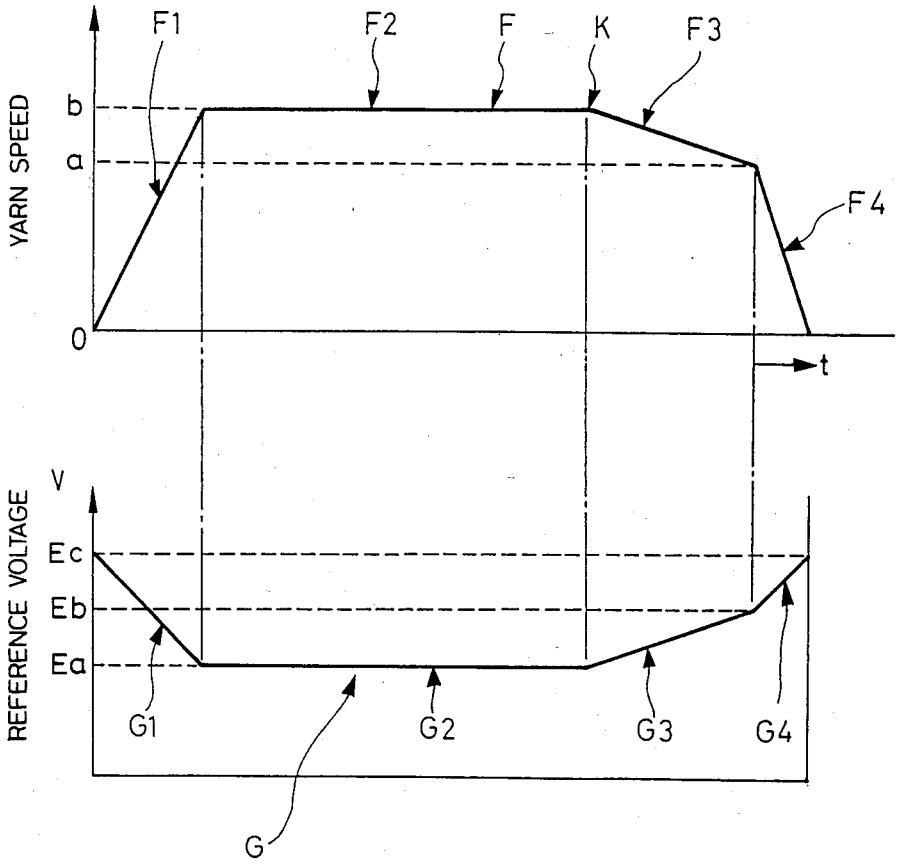
FIG. 9 is a diagram illustrating a relationship between a yarn speed and a reference voltage.

In order to eliminate such a possible circumstance as described just above, such a reference value correcting means as shown in FIG. 9 is preferably provided.

Figure 8:
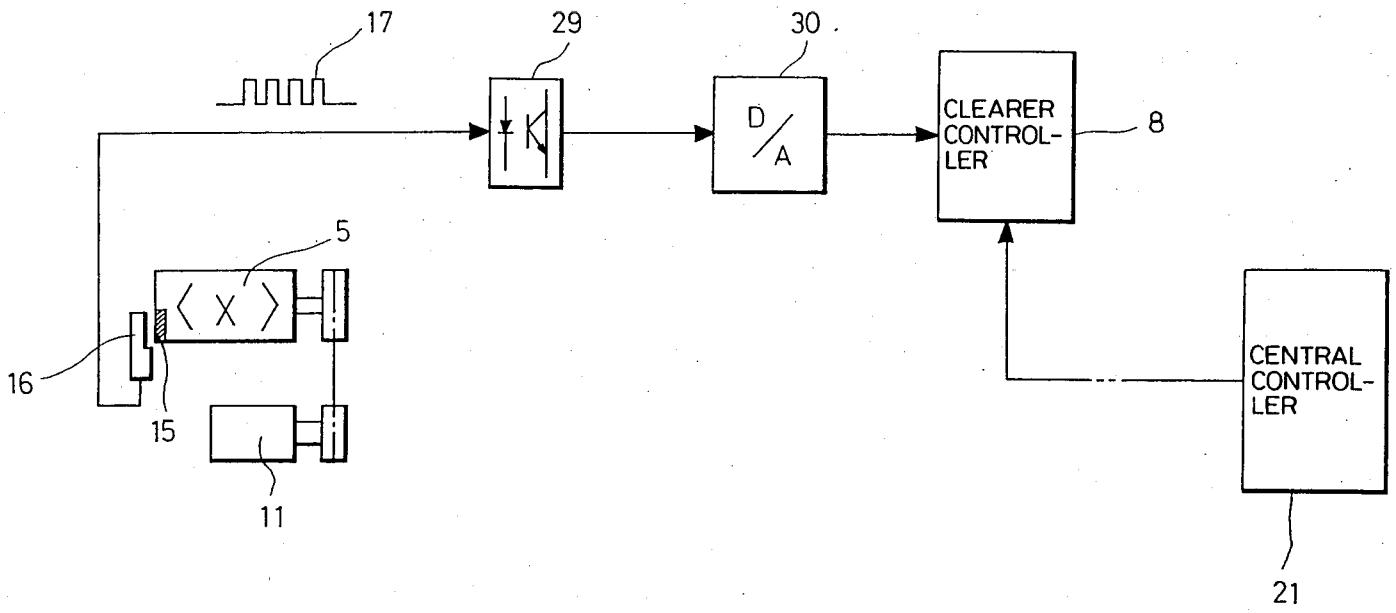
FIG. 8 is a block diagram showing an example of clearer controlling means.

Referring now to FIG. 8, a pulse signal 17 produced upon rotation of the drum 5 is delivered to an isolator 29 by means of which noises are removed from the pulse signal 17 and then to a digital to analog converter 30 by means of which it is converted into an analog voltage which corresponds to the yarn speed. The analog voltage is then applied to the clearer controller 8. In the clearer controller 8, a reference value which is set by way of the central control unit 21 provided for setting a reference length for all winding units of the automatic winder is corrected with the analog signal to form a corrected reference value.

Referring to FIG. 9, for example, at portions F1, F3, F4 of a diagram F at which the yarn speed varies with respect to the winding time, the reference voltage for the reference length is changed as a proportional function of the yarn speed as seen from another diagram G. It is to be noted here that the portion F1 of the diagram F which exhibits a change in the yarn feeding speed corresponds to a rising time of the traverse drum upon starting of winding, a portion F2 corresponds to a normal winding condition at a fixed speed, the varying portion F3 exhibits a decelerating condition in a yarn releasing tension increasing region, and the portion F4 indicates a rotating condition of the traverse drum by its own inertia when a fully wound up signal is developed.

Thus, as the yarn speed varies, the reference voltage V is varied as indicated by the diagram G. In particular, a portion G1 of the diagram G indicates a corrected voltage in the accelerating region F1 while another portion G2 indicates a set voltage for normal feeding of a yarn at a fixed speed, and when a reference value is set to each of the winding units from the central control unit of FIG. 9, normally a reference voltage Ea for the normal speed feeding is used. A further portion G3 of the diagram G indicates a corrected voltage in the decelerating region F3, and a still further portion G4 indicates a corrected voltage in the decelerating region F4.

Accordingly, while the yarn speed is varying, a detection value can be compared with a reference value corresponding to the yarn feeding speed then, and accordingly the length of a yarn defect which is influenced by the yarn feeding speed can be detected assuredly. Consequently, no wasteful cutting of a yarn is effected.

Now, winding control when sloughing occurs during winding will be described with reference to FIGS. 10 and 11.

Figure 10:
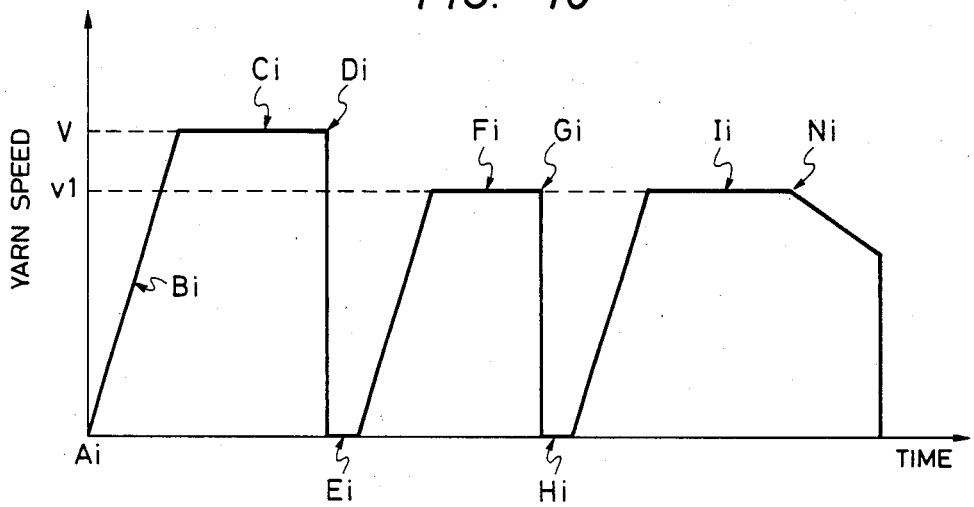
FIG. 10 is a yarn speed diagram illustrative an embodiment of winding control when sloughing occurs.

In particular, FIG. 10 shows a first embodiment, and if a new spinning bobbin is supplied to a rewinding position of the winding unit and rewinding is started as at Ai, the drum motor is accelerated as at Bi to a preset initial rotational speed V whereafter winding is performed at the fixed speed V as at Ci. If sloughing occurs on the way as at Di in FIG. 10, a sensing means for sensing such sloughing delivers an emergency signal so that the cutter 9 shown in FIG. 1 operates immediately to cut the yarn. It is to be noted that, for example, the slub catcher 4 may be used for the sloughing sensing means. The slub catcher 4 delivers an electric signal, and a degree of changing of the electric signal which appears when a thicker or thinner portion normally included in a yarn during feeding passes the slub catcher 4 is compared with a preset value in order to detect a defect portion of the yarn. In the present embodiment, a second preset value for detection of such a very large signal change as may be caused by sloughing is involved in the clearer 8 in addition to the first preset value for detection of a slub or the like. Accordingly, if a signal change, that is, a change in voltage, which exceeds the second preset value described above is detected, a sloughing detection signal 40 is delivered to the controlling circuit 19 to control the inverter 18 in response thereto. In particular, referring to FIG. 10, winding is re-started after lapse of a yarn splicing operation time Ei after yarn cutting due to occurrence of sloughing at Di, and in this instance, the winding speed is set to a value V before winding is re-started. While the difference V−v1 in speed is suitable selected to about 30 percent or so of the initial value V, it can be suitable changed depending upon a type of a yarn to be processed, an initial value V to be set, a thickness of a yarn used, and so on, and it is preferable to make it possible to adjust the setting of the controlling circuit 19 for reduction of the yarn speed.

Further, referring to FIG. 10, if sloughing occurs again during winding at the yarn speed v1, winding after another yarn joining operation as at Hi is performed at the present speed v1, as at Ii.

Figure 11:
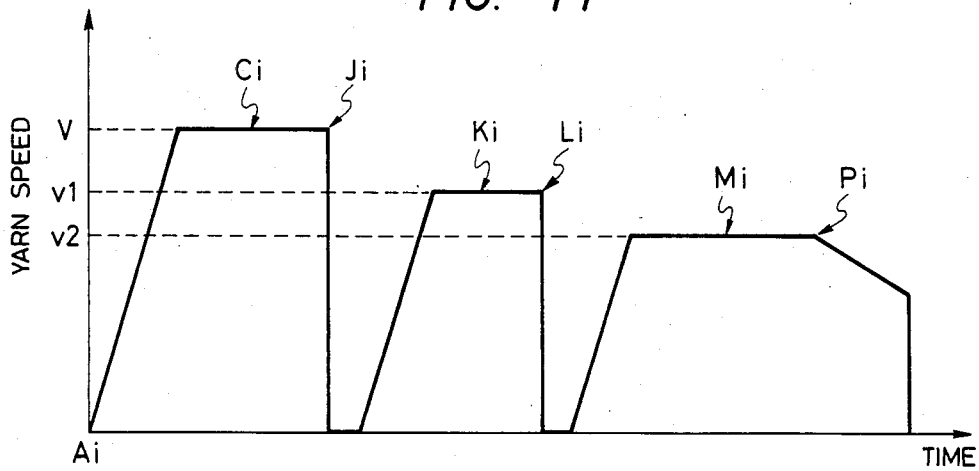
FIG. 11 is a yarn speed diagram illustrating another embodiment of such winding control.

FIG. 11 shows another embodiment. In particular, if winding is re-started at the yarn speed of the initial value V and then a yarn break occurs as a result of occurrence of sloughing as at Ji whereafer the winding speed after subsequent yarn joining is controlled to a value v1 by an inverter and then sloughing occurs again as at Li during such winding at the yarn speed v1 as at Ki, the yarn winding speed as at Mi after a subsequent second yarn joining operation is set to a value v2 further smaller than v1. Thus, in the second embodiment, each time sloughing occurs, the yarn winding speed after a subsequent yarn joining operation is re-set to a smaller value than the yarn winding speed before occurrence of the sloughing.

Thus, winding at a lower winding speed than the initial winding speed in this manner will make it more difficult for sloughing which may occur during winding at the yarn speed V to occur during winding at the yarn speed v1 and for sloughing which may occur during winding at the yarn speed v1 to occur during winding at the yarn speed v2.

It is to be noted that such yarn speed control is executed for a single spinning bobbin, and each time a new spinning bobbin is supplied to the winding position, the yarn speed is naturally re-set to the initial preset value V.

Referring again to FIGS. 10 and 11, points Ni, Pi at which the yarn speed changes correspond to a point at which the remaining amount of a yarn on a single spinning bobbin is reduced to such a degree that the yarn tension begins to increase, and it is effective for prevention of a wasteful yarn break if the yarn speed is lowered from such a tension increase beginning point as Ni or Pi.

As apparent from the foregoing description, according to the present invention, the speed of rotation of a drum motor can be changed for each of winding units of an automatic winder in accordance with circumstances of the winding unit, and accordingly wasteful operation of the winding unit can be prevented, which will improve the working efficiency of the winder and assure production of a package of a high quality on the winder. The present invention is very effective particularly for a high speed winder.

What is claimed is:

1. An automatic winder for performing a winding operation whereby yarn is drawn out from a layer of yarn wound on a spinning bobbin and is rewound onto a package, said automatic winder comprising:
   - a winding unit operable for drawing out and rewinding said yarn at a particular winding speed; and
   - a winding controlling means associated with said winding unit, for adjusting said particular winding speed at the lapse of a preset time period during the winding operation.

2. An automatic winder as claimed in claim 1, wherein said winding controlling means comprises:
   - a winding motor rotatable at a speed of rotation
   - an invertor for controlling said speed of rotation at which said winding motor rotates;
   - a controlling device operable for transmitting a control signal to said inverter for controlling said winding motor to rotate at said speed of rotation.

3. An automatic winder as claimed in claim 2, further comprising:
   - a central control unit for controlling said winding unit and for controlling said invertor.

4. An automatic winder as claimed in claim 2, wherein:
   - said winding unit is provided with a bobbin receiving position for receiving a bobbin supplied thereto; and
   - said controlling device comprises:
   - timing means, having a preset time period, said preset time period being dependent on the full amount of yarn on a bobbin supplied to said bobbin receiving position and on the yarn winding speed, said timing means for determining the lapse of said preset time period;
   - detection means for detecting the lapse of said preset time period following the receipt of a bobbin by said bobbin receiving position; and
   - signalling means, responsive to the lapse of said preset time period, for transmitting a deceleration instruction signal to said invertor for lowering said speed of rotation.

5. An automatic winder as claimed in claim 2 further comprising:
   - detection means for detecting an increase of yarn tension occurring during said winding operation; and
   - reducing means for reducing the rotational speed of said winding motor to reduce the yarn winding speed in response to a detection of an increase of yarn tension.

6. An automatic winder as claimed in claim 5, further comprising:
   - a yarn defect detecting means for detecting a defect in said yarn;
   - wherein said controlling device comprises signalling means responsive to the detecting of a defect in said yarn for transmitting a deceleration instruction signal to said invertor for controlling said winding speed.

7. An automatic winder as claimed in claim 6, further comprising:
   - a yarn break detecting means for detecting a break of said yarn during said winding operation; and
   - joining means responsive to the detection of a break of said yarn for joining said broken yarn;
   - wherein said controlling device comprises means for reducing said winding speed following the joining of said broken yarn.

8. An automatic winder as claimed in claim 2, further comprising:
   - detection means for detecting a reduction of the thickness of said yarn layer;
   - wherein said controlling device comprises deceleration signalling means for transmitting a deceleration instruction signal to said invertor in response to a detection of a reduction in thickness of said yarn layer.

9. An automatic winder as claimed in claim 1, wherein said winding controlling means further comprises:
   - defect deteccting means for detecting a defective portion of said yarn said defect detecting means comprises means for detecting the thickness and the length of said defective portion of said yarn;
   - signalling means for providing an electric signal corresponding to the thickness and the length of said defective portion of said yarn;
   - a comparator having a reference value, said comparator operable for comparing said electric signal with said reference value, said reference value being dependent on said winding speed.

10. A winding method in an automatic winder, comprising the steps of:

winding yarn at a first substantially constant winding speed;

detecting a break in said yarn;

joining the broken yarn;

winding said yarn at a second substantially constant speed which is lower than said first winding speed.

11. A winding device for performing a winding operation by winding yarn from a spinning bobbin to a package, said device comprising:

a winding means for winding said yarn at a winding speed;

a timing means for determining the lapse of a preset time period;

control means responsive to the lapse of the preset time period for altering said winding speed during said winding operation.

12. A winding device as claimed in claim 11, wherein said control means comprises:

a speed altering means responsive to said determining of said lapse of said preset time period for altering said winding speed.

13. A winding device for performing a winding operation by winding yarn from a spinning bobbin to a package, said device comprising:

a winding means for winding said yarn at a winding speed;

detection means for detecting a yarn defect in said yarn; and control means responsive to the detection of a yarn defect for lowering said winding speed.

14. A winding device for performing a winding operation by winding yarn from a spinning bobbin to a package, said device comprising:

a winding means for winding said yarn at a winding speed;

detection means for detecting a break in said yarn; and control mean responsive to the detection of a break in said yarn for lowering said winding speed.

15. A winding device as claimed in claim 11, wherein said control means comprises:

first speed controlling means for controlling said winding speed at a first, substantially constant speed prior to the lapse of said time period; and second speed controlling means for controlling said winding speed at a speed lower than said first, substantially constant speed following the lapse of said time period.

16. A winding device as claimed in claim 13, wherein said control means comprises:

first speed controlling means for controlling said winding speed at a first, substantially constant speed prior to said detection of a yarn defect; and second speed controlling means for controlling said winding speed at a speed lower than said first, substantially constant speed following said detection of a yarn defect.

17. A winding device as claimed in claim 14, wherein said control means comprises:

first speed controlling means for controlling said winding speed at a first, substantially constant speed prior to said detection of a break in said yarn; and second speed controlling means for controlling said winding speed at a speed lower than said first, substantially constant speed following said detection of a break in said yarn.

18. A winding method comprising the steps of:

winding yarn at a first substantially constant winding speed;

determining the lapse of a time period;

winding said yarn at a second substantially constant winding speed which is lower than said first winding speed following the lapse of the time period.

19. A winding method comprising the steps of:

winding yarn at a first substantially constant winding speed;

detecting a change in yarn tension;

detecting the presence of yarn at a cutting device;

operating said cutting device to cut said yarn upon detecting of both said change in yarn tension and said presence of said yarn at said cutting device;

joining said yarn; and winding said yarn at a second substantially constant winding speed which is lower than said first winding speed following the joining of said yarn.

* * * * *